United States Patent [19]

Berliner, III

[11] Patent Number: 5,032,027

[45] Date of Patent: Jul. 16, 1991

[54] ULTRASONIC FLUID PROCESSING METHOD

[75] Inventor: Samuel Berliner, III, Glen Cove, N.Y.

[73] Assignee: Heat Systems Incorporated, Farmingdale, N.Y.

[21] Appl. No.: 424,024

[22] Filed: Oct. 19, 1989

[51] Int. Cl.[5] ..... B01F 15/02; B01F 11/00

[52] U.S. Cl. ..... 366/15; 261/DIG. 48; 366/120

[58] Field of Search ..... 366/150, 108, 113, 114, 366/115, 116, 117, 118, 120, 127; 261/DIG. 48; 239/102.2; 123/25 E, 25 F

[56] References Cited

U.S. PATENT DOCUMENTS

| | | | |
|---|---|---|---|
| 3,072,808 | 1/1963 | Plesset | 366/117 |
| 3,246,881 | 4/1966 | Davidson | 366/118 |
| 3,715,104 | 3/1973 | Cottell | 366/118 |
| 3,749,318 | 7/1973 | Cottell | 261/DIG. 48 |
| 4,176,634 | 12/1979 | Martin | 261/DIG. 48 |
| 4,227,817 | 10/1980 | Gerry | 366/127 |
| 4,764,021 | 8/1988 | Eppes | 366/127 |

*Primary Examiner*—Robert W. Jenkins
*Attorney, Agent, or Firm*—Howard Paul Terry

[57] ABSTRACT

An ultrasonic fluid processing method is provided for cavitation and processing a first fluid with a second fluid in a sonication or cavitation zone. The method is useful for preparation of emulsions for chemical and pharmaceutical applications, to gasify liquids for purification, for chemical reactions, to accelerate chemical and physical reactions, and to suspend fine particles. The method includes the steps of, forming a vibration element having an axis and with an adjacent sonication or cavitation zone, enclosing the element and zone in a sealed cavity having a first fluid passage, forming a second fluid passage coaxially with the vibration element and disposed adjacent to the sonication zone, and forming a third fluid passage coaxially with the vibration element and disposed adjacent to the sonication zone. With this method, problems with the control of proportions and amounts and uniformity of parts of fluids being mixed or processed are avoided.

10 Claims, 4 Drawing Sheets

ULTRASONIC FLUID PROCESSING METHOD

The invention relates to an ultrasonic fluid processing method, and in particular the invention relates to an ultrasonic fluid processing method which uses vibration means and a cell with a plurality of concentric flow paths with openings so disposed as to provide materials to be processed simultaneously into a sonication or cavitation zone.

BACKGROUND OF THE INVENTION

The basic problem is one of intimately processing, for example, mixing a plurality of fluids, i.e.: intimately mixing a gas in a liquidj or a liquid in another liquid, or more than two phases, with accurate control of the passage of the two (or more) phases through the active portion of the device in which such mixing takes place. Secondarily and specifically, the problem is to prepare emulsions for chemical and pharmaceutical applications, to gasify liquids for purification and for chemical reactions, to accelerate physical and chemical reactions, and to suspend fine particles. Another problem is to intimately mix two reactive materials instantaneously as they enter a cavitation field. In many of the foregoing, it is also critical to control the atmosphere in which these processes take place, or to exclude any atmosphere. Fluids to which reference is made herein may or may not include entrained solid particles.

Prior art references describe four application methodologies. The first methodology (1) was the placement of the fluids in the tank of an ultrasonic cleaning bath or similar cavitating open vessel, as described quite extensively in early publications, such as "Ultrasonics . . . Science of a Coming Technology" (unattributed), in Industrial Laboratories, April 1952, and "Ultrasonically Induced Cavitation in Water" by G. W. Willard of the Bell Telephone Laboratories, in the Journal of the Acoustical Society of America, Volume 25, No. 4, Pp. 669–686, July 1953, and in U.S. Pat. Nos. 3,351,539 and 4,576,688. A further development of this methodolgy was the closure of the tank or vessel such that liquid could flow in a controlled manner in and out of the energy field, usually accompanied by provision of additional radiating surfaces to increase the intensity of the energy field, as described in Heat Systems-Ultrasonics, Inc. Technical Note HSU-TN-1, "Industrial Scale Ultrasonic Liquid Processing", dated April 1984. A second methodology (2) was the introduction into a static bath containing two or more fluids, of a probe vibrating at sufficiently high amplitude and frequency to generate cavitation, the creation of shock waves in liquid by formation and collapse of vapor bubbles, as described in U.S. patents such as U.S. Pat. No. 3,246,881. A further development of this technique was the enclosure of the probe tip and liquid bath in a pressure vessel with inlet and outlet provisions, thereby allowing pressurization of the bath and continuous flow of the liquid and other fluids, as described in Heat Systems-Ultrasonics, Inc. brochure S-803 dated May 1962 and in U.S. Pat. Nos. 3,394,274; 3,715,104; and 4,244,702. The third methodology (3) was the passage of the fluids past a vibrating knife edge or reed by which means cavitation was induced in the primary liquid, as described in Bulletin 60 from Sonic Engineering Corp. and in literature covering the SONOLATOR device from Sonic Engineering Corportation. The fourth methodology (4) was the forcing of fluids at extremes of pressure through greatly restricted orifices such that very high rates of shear were generated in the primary liquid, resulting in cavitation, as described in literature from APV-Gaulin Corp. One of many methods of purifying water through the introduction of ozone is discussed in U.S. Pat. No. 4,548,716, while one of many methods of purifying liquids and other substances by the application of ultrasonic energy is discussed in U.S. Pat. No. 4,477,357.

Prior art methods and methodologies are shown and described in Reprint PVI-2 entitled "Application of Ultrasonic Liquid Processors (Power vs. Intensity in Sonication)", by S. Berliner, III, dated April 1985, available from Heat Systems Incorporrated, 1938 New Highway, Farmingdale, N.Y. 11735, which describes typical equipment and applications; in "The Chemical Effects of Ultrasound", Pp. 80–86, SCIENTIFIC AMERICAN, February 1989, by Dr. Kenneth S. Suslick, which describes processes; and in Bulletin S-803, entitled "New Branson SONIFIER", available from Branson Instruments, Inc., which describes a device.

The problems with the prior art methodologies lie in (1) assuring uniform treatment of all aliquots or fractional parts of the fluid media being treated, (2) assuring that the proportions of the phases are accurately maintained during treatment, (3) assuring that equal amounts of all phases are present in the energy field at all times during treatment, (4) avoiding extremes of pressure in order to minimize the great danger presented by such pressure, and (5) controlling or excluding the atmosphere in which treatment occurs. A major drawback in the use of parallel plate transducers, and in cylindrical or polygonal transducers, which radiate inwards toward the longitudinal center of a flow path is that there are "dead" spots, places where vibrations cancel each other.

The method of this invention differs from the prior art methods in that this method uses concentric delivery passages or tubes through which the fluids are introduced into a high-intensity energy field in which cavitation is induced in the primary liquid. The major advantage offered by this arrangement is that the two (or more) parts of a resin, or similar material, are not brought into contact in any way outside of the sonication field. Injecting one part through, for example, an outer tube while injecting another part through an inner tube brings them into the sonication zone simultaneously. The central origin and radial flow assures uniformity of treatment of all aliquots, unlike the situation which pertains with the current devices.

As described in greater detail in the references by Berliner and by Suslick hereinbefore cited, the action of ultrasound in a liquid at extreme intensity results in the repeated rapid formation and extremely violent collapse of bubbles, generating shock waves which radiate throughout the liquid, a process known as cavitation or sonication. The collapse of the bubbles and passage of shock waves through a liquid containing other liquids, immiscible in the parent liquid, or gases or fine solid particles results in mixing, emulsification, gasification, deagglomeration and disaggregation, suspension and dispersion, and even the creation of new compounds otherwise unobtainable. This comes about from the high pressure and temperature generated in the collapse and in the passage of the shock wave and related effects, in which theoretical values of 10,000 atmospheres and 20,000° K. might obtain and in which actual values of at least 500 atmospheres and 5,500° C. have been calculated (Suslick, op. cit.). Such intense energy levels provide the means whereby the processes described can be enhanced and accelerated. Precise control of the introduction into, and passage through, the cavitation or sonication field or zone of the materials to be processed is all the more critical as the intensity increases. The present invention provides a superior method of achieving optimum results in a manner not hitherto practiced.

SUMMARY OF THE INVENTION

According to the present invention, an ultrasonic fluid processing method is provided. In a preferred embodiment, this method includes the steps of: forming a vibration face with an axis for disposing a sonication or cavitation zone adjacent to and coaxially with the vibration face; enclosing the vibration face and sonication zone in a sealed cavity having a first fluid passage; forming a second fluid passage coaxially with the vibration face and disposed adjacent to the sonication zone; and forming a third fluid passage coaxially with the vibration face and disposed adjacent to the sonication zone.

By using the sonication or cavitation zone and two coaxial fluid passages, the problems with the control of proportions and amounts and uniformity of the inlet fluids, and parts thereof, are avoided.

The foregoing and other objects, features and advantages will be apparent from the following description of the embodiments of the invention as illustrated in the accompanying drawings.

DESCRIPTION OF THE PREFERRED EMBODIMENTS

Figure 1:
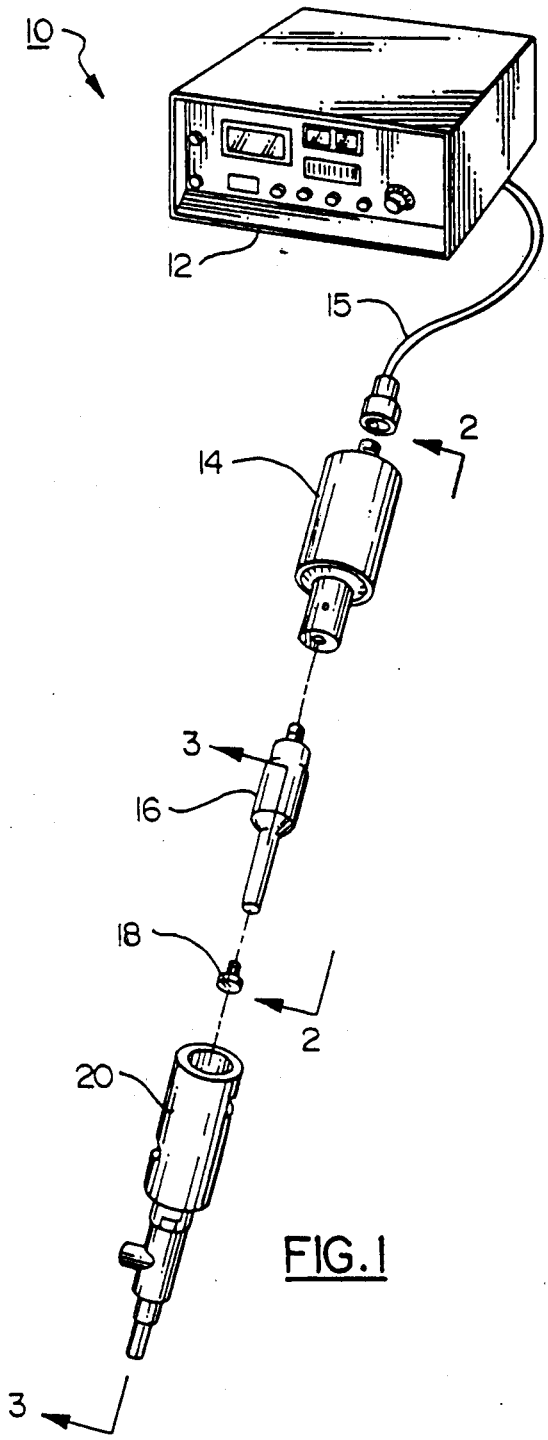
FIG. 1 is a perspective view of a first embodiment or system using the method according to the invention.
Figure 2:
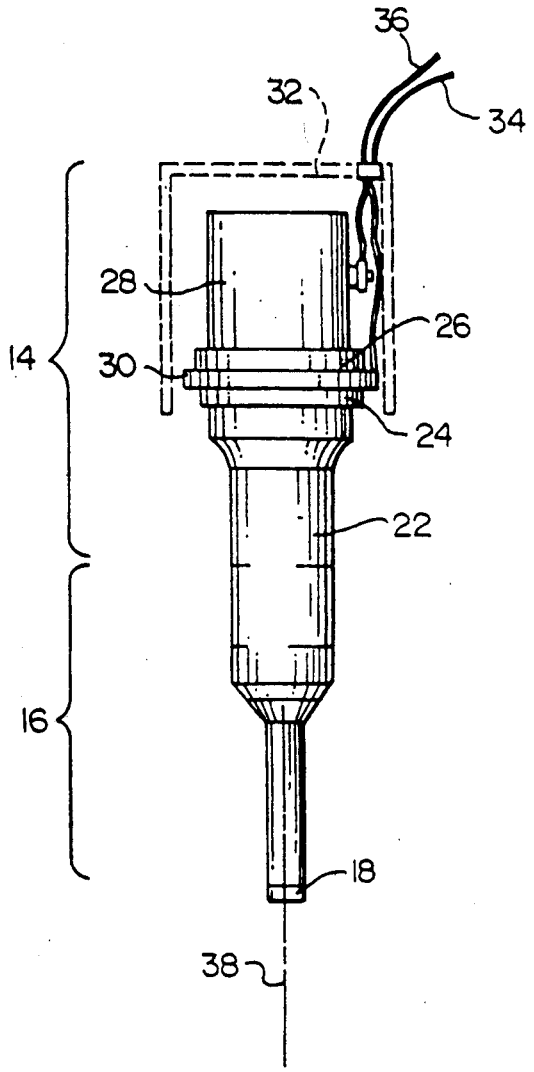
FIG. 2 is an elevation view as taken along line 2—2 of FIG. 1.

As shown in FIGS. 1 and 2, a first embodiment, or system, or assembly 10, which uses the invention, is provided. System or assembly 10 includes a generator 12, a converter 14 with a cable 15, a horn 16, which has a flat tip 18, and a cell 20. In the embodiment shown, converter 14 has a front driver 22, lower transducer crystal 24, an upper transducer crystal 26, and a back driver 28. Converter 14 also has a center electrode 30, a case 32, a first lower wire 34, a second upper wire 36. Converter 14 and horn 16 have a common axis 38.

Generator 12, which is an ultrasonic power supply, changes power from an electrical source to that required to energize and control the converter 14. Converter 14, which is an ultrasonic converter, or transducer, or power head, connects to horn 16. Converter lower crystal 24 and upper crystal 26, which are piezoelectric crystals, resonate in an axial direction, along axis 38. Crystals 24 and 26 are prestressed and fitted between front driver 22 and back driver 28. Front driver 22, back driver 28, crystals 24, 26, and electrode 30, form a subassembly, which is called a stack, and which is a resonant body. Energy, typically up to 1,000 volts, is conducted to crystals 24, 26 by center electrode 30. Wires 34, 36, which connect to center electrode 30 at the ends thereof, connect to cable 15 at the other ends thereof. Cable 15 is a shielded high frequency cable. Horn 16 and front driver 22 are mechanical vibration amplifiers. Case 32, which is a housing, encloses and isolates the upper part of converter 14, which is both electrically and mechanically active. Horn 16 has a free resonant action, during operation thereof. The connection between horn 16 and cell 20 does not interfere with such free resonant action of horn 16. Horn 16 causes cavitation in fluid passing through cell 20.

Figure 3:
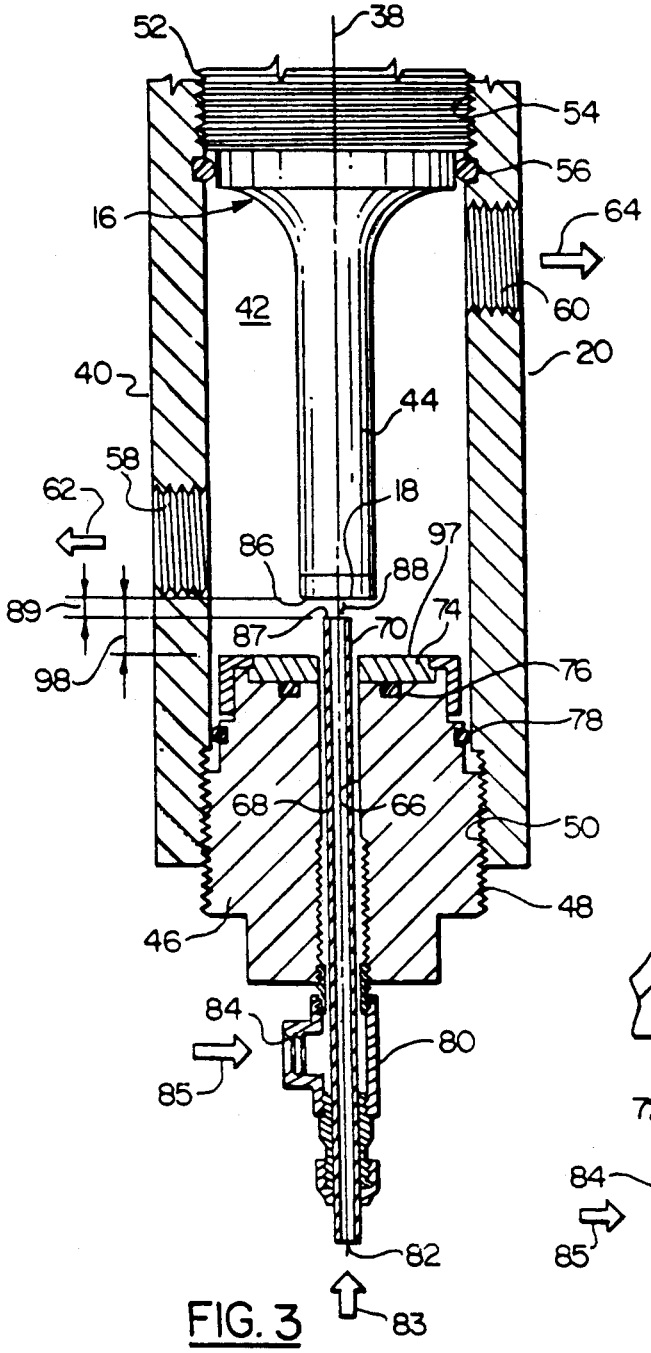
FIG. 3 is a section view as taken along line 3—of FIG. 1.
Figure 4:
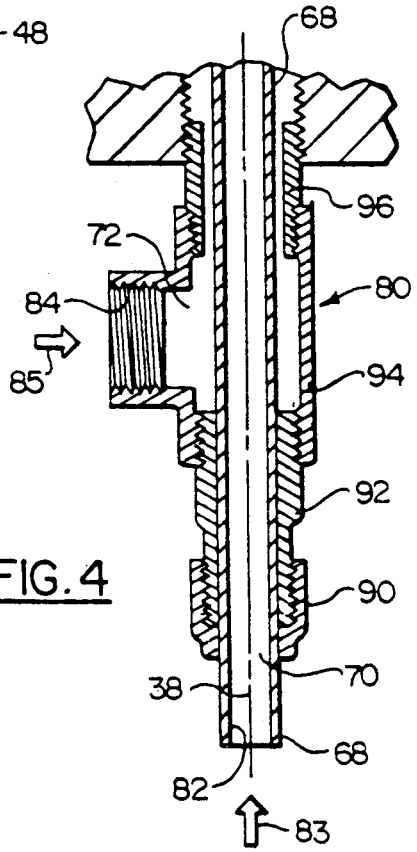
FIG. 4 is an enlarged view of a portion of FIG. 3.

As shown in FIGS. 3 and 4, cell 20 is coaxial with horn 16 along axis 38. Cell 20 has a peripheral wall or housing wall 40, which encloses a cavity 42. Horn 16 has an elongate stem portion 44, which supports tip 18. Cell 20 has a bottom end wall 46 with external threads 48, which are received by internal threads 50 of wall 40. Horn 16 also has external threads 52, which are received by internal threads 54 at the top of wall 40. Horn 16 has a ring seal 56, which is disposed adjacent to threads 52, 54. Peripheral wall 40 has a main outlet opening 58 and an auxiliary outlet opening 60. Opening 58 has a flow direction 62, and opening 60 has a flow direction 64. End wall 46 has a wall or tubular portion that has an elongate hole 66, which receives an elongate tube 68, thereby forming an inner passage 70 and an outer passage 72. Passages 70, 72 are concentric about axis 38.

End wall 46 has a two-piece integral cap member 74, which has a relatively small diameter ring seal 76. End wall 46 has a relatively large diameter ring seal 78, disposed adjacent to threads 48, 50. Tube 68 is supported by a pipe assembly 80, which has a side inlet opening 84, that has a flow direction 85, and that connects to passage 72. Tube 68 has a bottom inlet opening 82, which has a flow direction 83, and which connects to inner passage 70. Tip 18 has a flat end face 86, which faces tube 68 at its end, forming therebetween a gap 89. Pipe assembly 80 is also supported by end wall 46.

As shown in FIG. 4, pipe assembly 80 includes a lower compression seal-type collar 90, which has a part disposed over tube 68 and which has a part threaded over a lower pipe 92. Lower pipe 92 is threaded into a T-shaped connector pipe 94, which is threaded over an upper pipe 96. Pipe 96 is threaded at its upper end into wall 46, adjacent to outer passage 72. Face 86 is also disposed opposite to face 97 of member 74 forming a gap 98. Gaps 89, 98 define a sonication or cavitation zone 88. End wall 46 together with member 74 can be positioned for adjusting the size of gap 98. Then collar 90 can be loosened to adjust the gap 89 of zone 88. In the process, housing wall 40 is connected and sealed to horn 16 providing concentric passages 70, 72, which provide concentric introduction of fluids to sonication zone 88. A primary fluid flows through outer passage 72 to zone 88. A secondary fluid flows through inner passage 70 to zone 88, which is next to flat face 86 of horn tip 18. Seals 56 and 78 retain gas and fluid within cavity 42. The primary fluid enters opening 84 to outer passage 72. Secondary fluid enters opening 82 to inner passage 70. Outlet opening 58 carries out the processed fluids. Auxiliary outlet opening 60 removes excess gases involved in fluid processing. It will be understood that at least one of the fluids must be a liquid for cavitation to occur.

With this construction using system 10, the method of manufacture and processing provides an application of high-intensity ultrasonic energy in liquid processing for intimate mixing of a fluid in a liquid, i.e.: intimate mixing of a gas in a liquid, or a liquid in another liquid, or more than two phases, and associated effects. Associated effects include shearing of materials, sterilization, surface chemistry, acceleration of physical and chemical reactions, curing of epoxies and other polymers, processing biomaterials, suspending fine particles, and production of extremes of pressure and temperature. Ultrasonic energy is used for high-shear mixing, emulsification, and gasification.

Introduction of two or more reactants, components, or phases, or the like, into a cavitation field or zone results in their being broken into minute aliquots and forced into intimate contact. This, in turn, produces very high surface area on which reactions can occur, which combines with extremely high localized pressures, temperatures, and shear rates. The high energy levels involved result in excellent mixing, even of otherwise immiscible liquids; accelerated reactions between chemical elements and compounds, even to the creation of compounds not previously obtainable through other means; enhanced sparging of gases such as oxygen or ozone which can act as purifiers for potable water; and outstanding emulsification and suspension as the shock waves resulting from the collapse of cavitation bubbles force molecules of one part through the interface into the other part and vice-versa or separate and disperse fine particles.

The material of construction of horn 16 is normally titanium alloy, although other materials of low acoustic impedance can and have been used, notably Monel metal. Titanium is both very strong and light, has virtually the same chemical resistance as stainless steel, and is resistant to erosion in the cavitation field. Aluminum, which has the lowest acoustic impedance of any metal, is not normally appropriate because of its low resistance to erosion in the cavitation field and high chemical reactivity. The materials of construction of the pressure-containing housing or cell, 20, and the appurtanences 46, 80, thereto are normally stainlesss steel, with Buna-N (nitrile rubber) seals.

Figure 5:
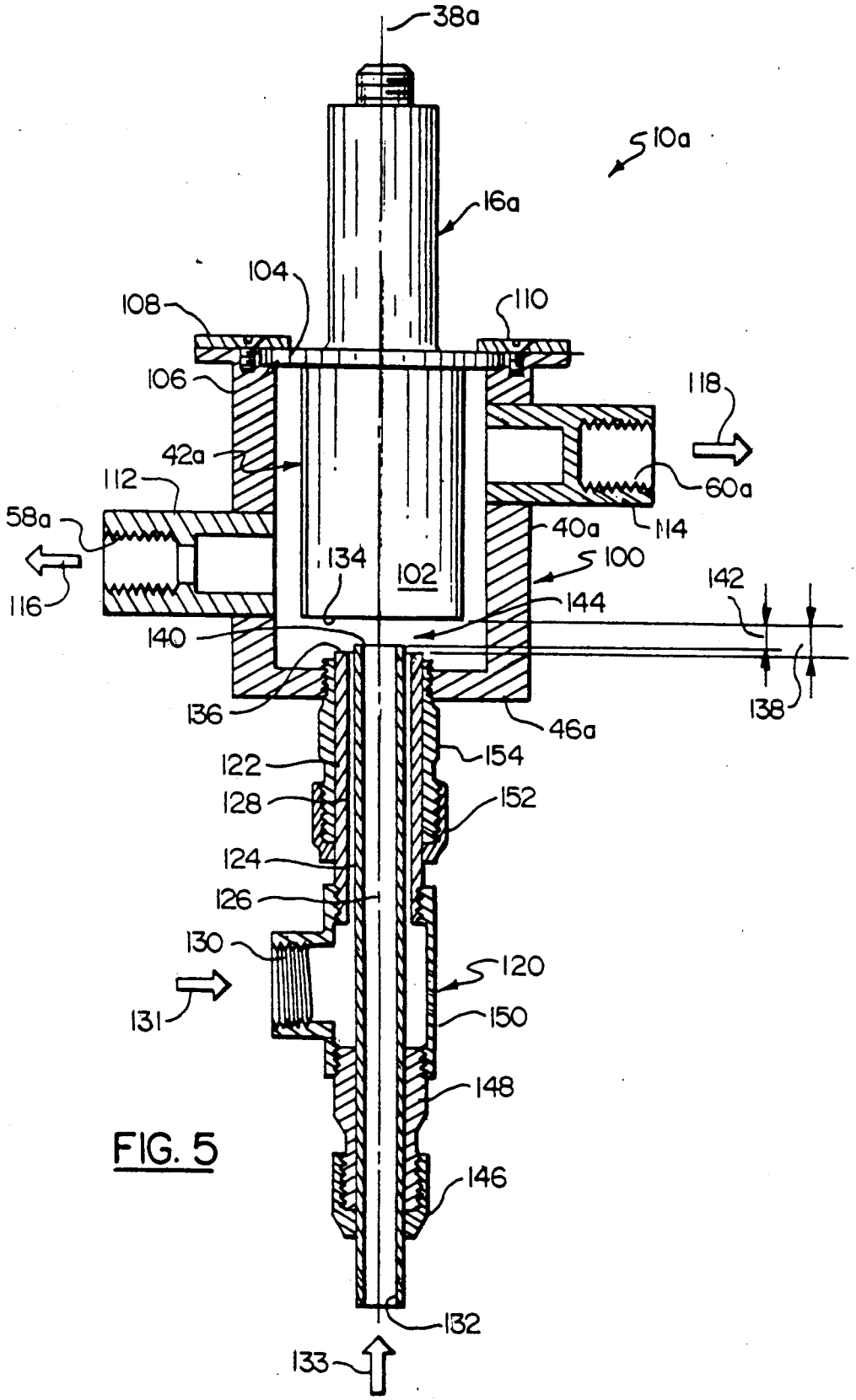
FIG. 5 is a section view, corresponding to FIG. 3, of a second embodiment using the invention.
Figure 9:
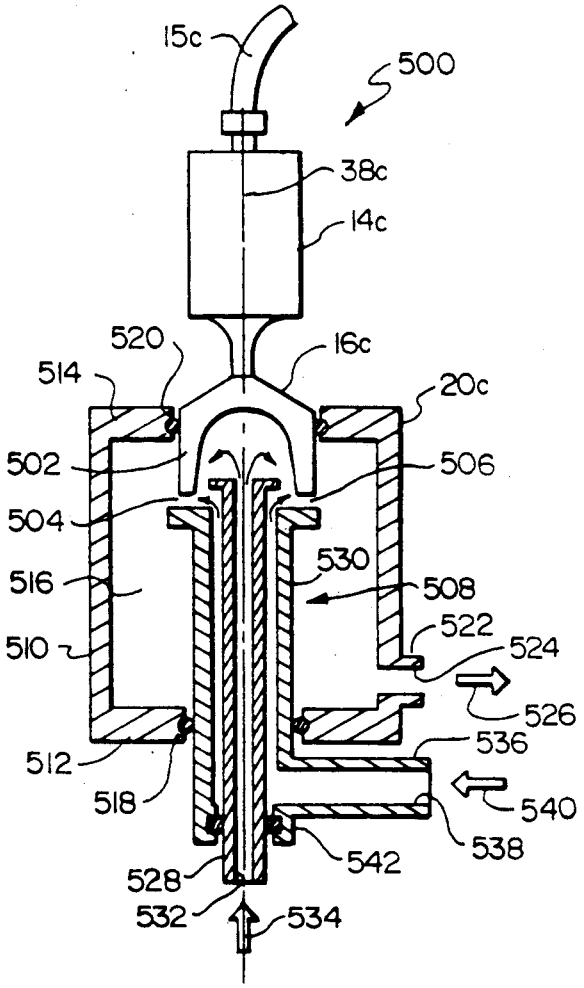
FIG. 9 is a schematic section view, corresponding to FIG. 3, of a sixth embodiment using the invention.

The dimensions of horn 16 are limited only by the body diameter of the horn, which, to avoid fatigue failure, is generally limited to about 3.3" (8.4 cm). Laboratory-scale horns are typically 1.5" (3.8 cm) in body diameter with 0.5" (1.3 cm) to 1" (2.5 cm) output diameters. Corresponding cell housings 40 are usually 2" (5 cm) in diameter and about 5" (12.5 cm) long. Length of the horn and housing is determined by the frequency at which the convertor/transducer and horn resonate, conventionally 20 kHz (20,000 cycles per second), but sometimes 40 kHz. Other frequencies are also acceptable, subject to noise and efficiency considerations. The horn 16 is normally one half wavelength long, which, in aluminum or titanium at 20 kHz is nominally 5" (12.5 cm). Cells 20, which might be used on a laboratory scale, require only approximately 500 watts and process in the range of 10 U.S. gallons (40 liters) per hour. For industrial processes, horn diameters may approach the aforementioned limit and the cell dimensions might approach or exceed 3.5" (8.9 cm) diameter by 7" (17.8 cm) long; such a cell, as depicted in FIG. 5, might require as much as 2,500 watts of power and process in the range of 10 U.S. gallons (40 liters) per minute. The dimensions of all other parts are proportional to those described; other than those determined by wavelength, dimensions are not critical to the invention. Techniques exist which allow the use of horns even wider than 3.3" (8.4 cm), usually requiring relieving the body by hollowing out the body, resulting in a cup or bell-shaped horn as shown in FIG. 9. Spacing of the radiating face 86 of horn 16 from the delivery tube 68 is generally close, in the range of 0.125" (0.32 cm) to 0.5" (1.27 cm), but can best be determined empirically for each unique application.

A second embodiment or assembly **10*a*, which uses the method of the invention, is shown in FIG. 5. Parts of assembly 10*a*, which are the same as corresponding parts of assembly 10, have the same numerals, but with a subscript "a" added thereto. Assembly 10*a*has an industrial scale or industrial type subassembly including cell 100 and horn 16*a*, which are coaxial along axis 38*a*. Cell 100 has a peripheral wall 40*a* with a cavity 42*a*. Horn 16*a* has an enlarged output section 102 and an integral annular top flange 104. Cell 100 has a recess 106 and ring 108 with screws 110 to position and secure flange 104. Cell 100 has a bottom end wall 46*a* which is integral with peripheral wall 40*a*. Peripheral wall 40*a* has an integral lower projecting pipe 112, which has a main outlet opening 58*a* and has an integral upper projecting pipe, which has an auxiliary outlet opening 60*a*. Openings 58*a*, 60*a* have respective fluid flow directions 116, 118**.

End wall **46*a* supports a tube assembly 120 and supports an outer tube or tubular portion 122, which supports an inner tube 124. Inner tube 124 encloses an inner passage 126. Outer tube 122 and inner tube 124 have an outer passage 128 therebetween. Passages 126, 128 are concentric about axis 38*a***.

Pipe assembly 120 has a side inlet opening 130, which has a fluid flow direction 131, and which connects to outer passage 128. Pipe assembly 120 also has a bottom inlet opening 132, which has a fluid flow direction 133, and which connects to inner passage 126. Enlarged horn output section 102 has an end face 134. Face 134 is disposed opposite to face of tube 122 forming a gap 138. Face 134 is disposed opposite to face 140 of tube 124 forming a gap 142. Gaps 138, 142 define a sonification or cavitation zone 144 between face 134 and faces 136 and 140.

Pipe assembly 120 also has a lower compression collar 146, which is disposed over inner tube 124, and which is threaded over a lower pipe 148, that is threaded into a T-shaped connector pipe 150, that is threaded over outer tube 122. Pipe assembly 120 also has an upper compression collar 152, which is disposed over outer tube 122, and which is threaded over an upper pipe 154, that is threaded into bottom end wall **46*a*. Upper compression collar 152 can be loosened first for adjusting the size of gap 138 of outer tube 122. Then, lower compression collar 146 can be loosened for adjusting gap 142. The gaps 138, 142 can be set for optimum processing of fluids from passages 126, 128. In the method or process, fluid flow is like the method or process of assembly 10**.

Figure 6:
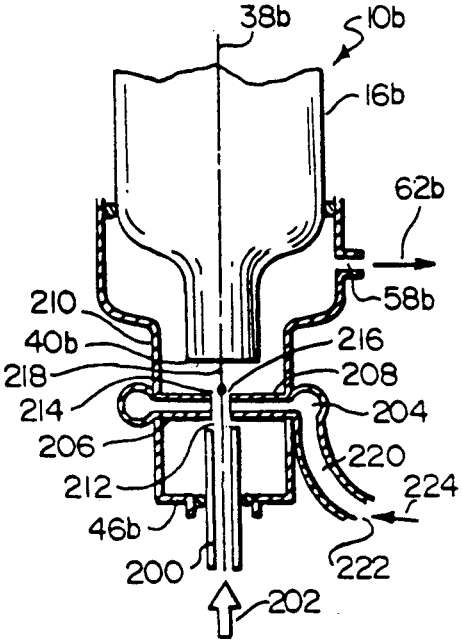
FIG. 6 is a schematic section view, corresponding to FIG. 3, of a third embodiment using the invention.

A third embodiment of the invention which uses the method of the invention, is shown in FIG. 6. Parts of third embodiment or cell **10*b*, which are the same as parts of first embodiment or assembly 10 have the same numerals, but with a subscript "b" added thereto. Assembly 10b has a horn 16b and a cell 20b, which are coaxial along axis 38b. Cell 20b has an outlet opening 58b with a fluid flow direction 62b. Cell 20b has a peripheral wall 40b and a bottom end wall 46b. End wall 46b has an inlet tube 200 with a fluid flow direction 202. Peripheral wall 40b supports a toroidal or ring-shaped collector ring or pipe 204. Pipe 204 has a plurality of relatively small inlet tubes represented graphically by tubes 206, 208. Alternatively, the inlet tubes 206, 208 could be in the form of a manifold or annulus. Horn 16b has a vibration face 210. Inlet pipe 200 has an end face 212. Tubes 206, 208 have respective end faces 214, 216. Faces 210, 212, 214, 216 enclose a sonication zone 218. Collector ring 204 has a tube or pipe 220, which has an inlet opening 222 with a fluid flow direction 224. In this process, a primary fluid enters zone 218 from outer tubes 206, 208. A secondary fluid enters zone 218 from inner pipe 200. A fluid mixture exits from outlet opening 58b**.

Figure 7:
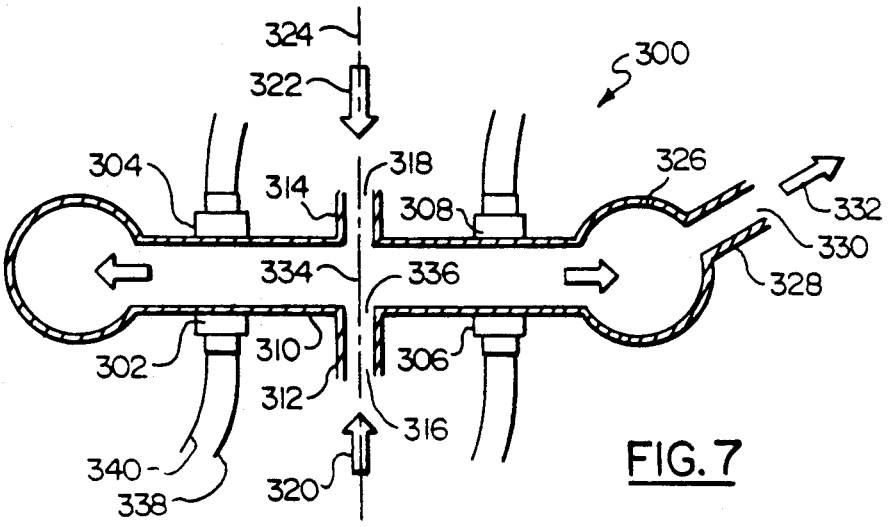
FIG. 7 is a schematic section view, corresponding to FIG. 3, of a fourth embodiment using the invention.

A fourth embodiment, which uses the method of the invention, is shown in FIG. 7. Fourth embodiment or assembly 300 has a plurality of transducers, represented graphically by four transducers 302, 304, 306, 308 which are fitted to a manifold or pipe 310. Manifold 310 has two inlet tubes 312, 314, which have respective openings 316, 318 with respective fluid flow directions 320, 322. Tubes 312, 314 are coaxial along an axis 324. Manifold has a collector ring or pipe 326, which is coaxial with inlet tubes 312, 314. Collector ring 326 has an outlet pipe 328, which has an outlet opening 330 with a fluid flow direction 332. In the method or process, primary fluid from tube 312 and secondary fluid from tube 314 enter a sonication zone 334. Manifold inner surface 336 forms a vibration surface, disposed above and below and around zone 334. Transducer 302 has typical electrical wires 338, 340, like transducers 304, 306, 308 for supply of power for vibrating manifold inner surface 336. The fluid mixture leaves zone 334, and exits through manifold 310, to collector ring 326, then out through outlet pipe 328.

Figure 8:
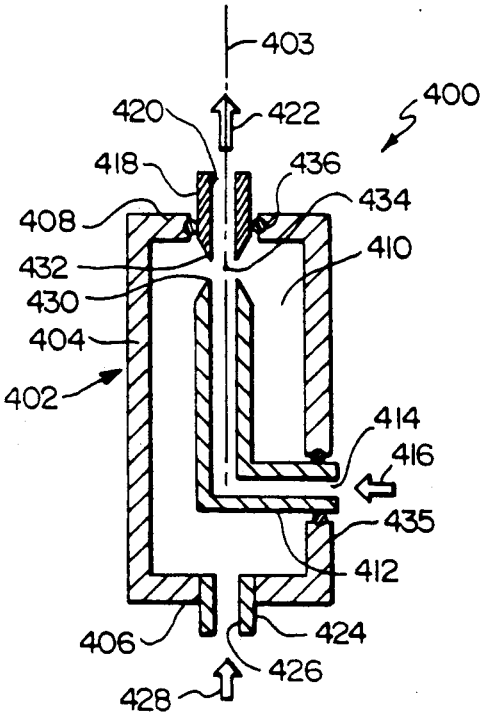
FIG. 8 is a schematic section view, corresponding to FIG. 3, of a fifth embodiment using the invention.

A fifth embodiment, which uses the method of the invention, is shown in FIG. 8. The same cavitational fluid processing action as in the first embodiment can also be obtained in this fifth embodiment or assembly 400 by passing a liquid at a relatively high pressure and velocity past a vibrating reed or knife edge and configuring the reed or edge in a cylindrical form located concentrically inside or outside of a delivery pipe or tube containing the flow of a second fluid.

Assembly 400 has a vessel 402, which has an axis 403, a peripheral wall 404, a lower end wall 406, and an upper end wall 408, which enclose a cavity 410. Peripheral wall 404 supports an inlet tube 412, which has an inlet opening 414 with a fluid flow direction 416. Upper end wall 408 has an outlet tube 418, which has an outlet opening 420 with a fluid flow direction 422. Lower end wall 406 has a second inlet tube 424, which has an inlet opening 426 with a fluid flow direction 428. Vessel 402 thus inherently forms a delivery means for fluid flow direction 416 concentric with fluid flow direction 428. Lower tube 412 has a knife edge, or vibrating reed type of edge, 430. Upper tube 418 may also has a knife edge 432. In the method or process, primary fluid flows through inlet tube 424, then through cavity 410, then through an annular space which defines cavitation or sonication zone 434 between knife edge 430, or vibrating reed edge and other edge 432, then out through outlet tube 418. Secondary fluid flows through lower inlet tube 412, then passes by knife edge 430 and other edge 432, then flows through upper outlet tube 418. Cavitation of the liquid phase or phases and processing of the fluids occurs in zone 434 by means of vibrations passed radially inwards or outwards of knife edge or vibrating reed edge 430 and edge 432. The cavitation results, in the case of knife edges 430, 432, from the passage of fluid at relatively high pressure and velocity past the sharp edges, giving rise to a sudden expansion into cavity 410, which when carefully tuned to the resonant frequency of the cavity results, in alternating postive and negative pressure waves being transmitted into the liquid phase or phases. Cavitation also results, in the case of vibrtating reed edge 430, from the passage of fluid at relatively high pressure and velocity past the reed edge, giving rise to vibration of the edge at a high frequency and transmission of such vibration into the liquid phase or phases. The edge 430 has a face which vibrates radially and which is adjacent to the sonication zone 434. Fluids are retained in cavity 410 by seals 435, 436.

A sixth embodiment, which uses the method of the invention, is shown in FIG. 9. Parts of sixth embodiment or assembly 500 which are like parts of the first embodiment 10 have the same numerals but with a subscript "c" added thereto. Assembly 500 has a converter 14c with a cable 15c, a cup or bell-shaped horn 16c and a housing or vessel or cell 20c. Converter 14c has an axis 38c. Converter 16c has substantially the same structure as converter 14 of first embodiment 10. Ring horn 16c has the same structure as horn 16, but ring horn 16c has an internally-relieved bell-shaped lower portion or bell portion 502. Bell portion 502 has a ring-shaped radiation face 504. Face 504 forms an upper part of an annular sonication zone 506. Cell 20c has a pipe assembly 508. Cell 20c has a peripheral wall 510, a lower end wall 512, and an upper end wall 514 enclosing a cavity 516. Lower wall 512 has a seal ring 518, which engages pipe assembly 508. Upper wall 514 has a seal ring 520, which engage bell lower portion 502. Peripheral wall 510 has an outlet pipe 522, which has an outlet opening 524 with a fluid flow direction 526. Pipe assembly 508 has an inner tube 528 and an outer tube 530, coaxial along axis 38c. Inner tube 528 has an inlet opening 532 with a flow direction 534. Outer tube 530 has an inlet pipe 536 which has an inlet opening 538 with a flow direction 540. Outer tube 530 has a seal ring 542, which engages inner tube 528. In the method or process, primary fluid flows between outer tube 530 and inner tube 528. Secondary fluid flows through inner tube 528. The primary and secondary fluids mix radially outwardly in, and pass through, annular sonication or cavitation zone 506, then pass into cavity 516, and exit at outlet pipe 522.

While the method of invention has been described in its preferred embodiments, it is to be understood that the words which have been used are words of description rather than limitation and that changes may be made within the purview of the appended claims without departing from the true scope and spirit of the invention in its broader aspects.

The embodiments of an invention in which an exclusive property or right is claimed are defined as follows:

1. An ultrasonic fluid processing method including the steps of:

forming a vibration face with an axis for disposing a sonication zone adjacent to and coaxially with the vibration face;

enclosing the vibration face and sonication zone in a sealed cavity having a first fluid passage;

forming a second fluid passage coaxially with the vibration face and disposed adjacent to the sonication zone; and forming a third fluid passage coaxially with the vibration face and disposed adjacent to the sonication zone.

2. The method of claim 1, including the step of:

supplying electrical power and converting the electric power to ultrasonic sound waves for making the sonication zone.

3. The method of claim 2, including the step of:

arranging the second fluid passage concentric about the axis and arranging the third fluid passage concentric about the axis and about the second fluid passage.

4. The method of claim 3, including the step of:

adjusting a length of a dimension from the vibration face to an opening from the second fluid passage.

5. The method of claim 4, including the step of:

adjusting a length of a dimension from the vibration face to an opening from the third fluid passage.

6. The method of claim 1, including the step of:

forming a toroidally shaped assembly of openings from the second fluid passage.

7. The method of claim 1, including the step of:

forming a pair of oppositely disposed radial outlet passages from the sonication zone.

8. The method of claim 1, including the step of:

forming an annular opening from the second fluid passage coaxial and concentric about the sonication zone.

9. The method of claim 1, including the step of:

forming a circular vibration face for providing an annular sonication zone adjacent thereto,

10. An ultrasonic fluid processing method, for cavitation and processing a first fluid with a second fluid in a sonication zone, including the steps of:

forming a vibration element having an axis and having an adjacent sonication zone;

enclosing the element and zone in a sealed cavity having a first fluid passage;

forming a second fluid passage coaxially with the vibration element and disposed adjacent to the sonication zone; and forming a third fluid passage coaxially with the vibration element and disposed adjacent to the soncication zone.

* * * * *